United States Patent [19]

Kyle

[11] 4,214,338

[45] Jul. 29, 1980

[54] INDUSTRIAL SWEEPER

[76] Inventor: Allan H. Kyle, P.O. Box 88, Kempsey, New South Wales, Australia, 2440

[21] Appl. No.: 9,667

[22] Filed: Feb. 5, 1979

[30] Foreign Application Priority Data

Feb. 9, 1978 [AU] Australia ..... PD3318

[51] Int. Cl.[2] ..... A47L 11/292

[52] U.S. Cl. ..... 15/83; 15/50 C

[58] Field of Search ..... 15/50 C, 49 C, 79 R, 15/79 A, 82, 83

[56] References Cited

U.S. PATENT DOCUMENTS

| | | | |
|---|---|---|---|
| 2,268,059 | 12/1941 | Parker et al. | 15/83 |
| 2,298,054 | 10/1942 | Howell | 15/83 X |
| 2,709,269 | 5/1955 | Williams | 15/83 X |
| 3,178,746 | 4/1965 | Voelstad | 15/83 |
| 3,354,489 | 11/1967 | Ehrlich | 15/83 |
| 3,568,232 | 3/1971 | Swanson | 15/83 |

FOREIGN PATENT DOCUMENTS

| | | | |
|---|---|---|---|
| 454105 | 1/1949 | Canada | 15/83 |

*Primary Examiner*—Edward L. Roberts

*Attorney, Agent, or Firm*—Darby & Darby

[57] ABSTRACT

The invention relates to sweeping apparatus, or more specifically an industrial sweeper, which is adapted to be mobilized by an external prime mover and which relies for its operation upon the rotation of a cylindrical sweeping brush rotatable in response to the rotation of the wheels of the sweeper when the latter is motivated as aforesaid by the external prime mover. A refuse catcher and a water sprinkler are also provided so that the ground ahead of the path of travel of the sweeper is lightly dampened and refuse which is swept up by the cylindrical brush is thrown into the refuse catcher.

9 Claims, 3 Drawing Figures

INDUSTRIAL SWEEPER

This invention relates to an industrial sweeper which is particularly adapted for the cleaning of roadways and large areas such as factory floors. More particularly, the present invention provides an industrial sweeper which is attachable to a prime mover, such as a fork lift, and which enables the rapid and efficient cleaning of driveways, factory floors, and other large areas where regular cleaning must be performed quickly and with a minimum of obstruction.

Hitherto, there have been devised industrial sweepers wherein a self-motivated carriage includes a rotational brush which is operative to sweep refuse in a particular, predetermined direction. However, this type of sweeper is costly to construct and suffers from the very distinct disadvantage that it only directs refuse to a particular position so that the refuse then must be gathered by another appliance. Also, there is not known to the Applicant any existing industrial sweeper which may be motivated by an existing form of prime mover, such as a fork lift. Since fork lifts are generally in constant use within most large industrial establishments, the use of such means of motivation for the industrial sweeper of the present invention is both convenient and cost saving since the sweeper does not require its own independent means of motivation.

These disadvantages of the aforementioned prior art are overcome by the provision of an industrial sweeper which is operable from a fork lift or other commonly used means of motivation and which, by employing ground dampening and refuse collecting apparatus, ensures that a cleaning operation is performed quickly and efficiently during only one traverse of the area to be cleaned.

According to the present invention, there is provided sweeping apparatus comprising a framework having forward and rearward ends, an axle assembly bearing a pair of ground engaging rear wheels and mounted transversely in the vicinity of the rearward end of said framework, a pair of independently suspended ground engaging front wheels mounted substantially toward the forward end of said framework, a cylindrical sweeping brush comprising an elongate shaft with bristles extending radially therefrom and along the length thereof rotatably mounted transversely within said framework, an elongate refuse catcher substantially equal in length to said sweeping brush and mounted near and substantially parallel thereto within said framework and drive means connecting said axle assembly and said sweeping brush to cause the latter to rotate about its cylindrical axis in response to the rotation of said rear wheels.

Additionally, the aforesaid invention may further comprise an elongate, perforated sprinkler pipe extending across the forward end of said framework forwardly of and substantially parallel to said sweeping brush, a water tank and a water pump both mounted within said framework, water lines connecting an outlet of said water tank to an inlet of said water pump and an outlet of said water pump to said sprinkler pipe and drive means connecting said axle assembly and said water pump to cause the latter to pump water from said water tank to said sprinkler pipe whereupon water is sprayed through the perforations in said sprinkler pipe in response to the rotation of said rear wheels.

A preferred embodiment of the present invention will now be described with reference to the accompanying drawings in which.

Figure 1:
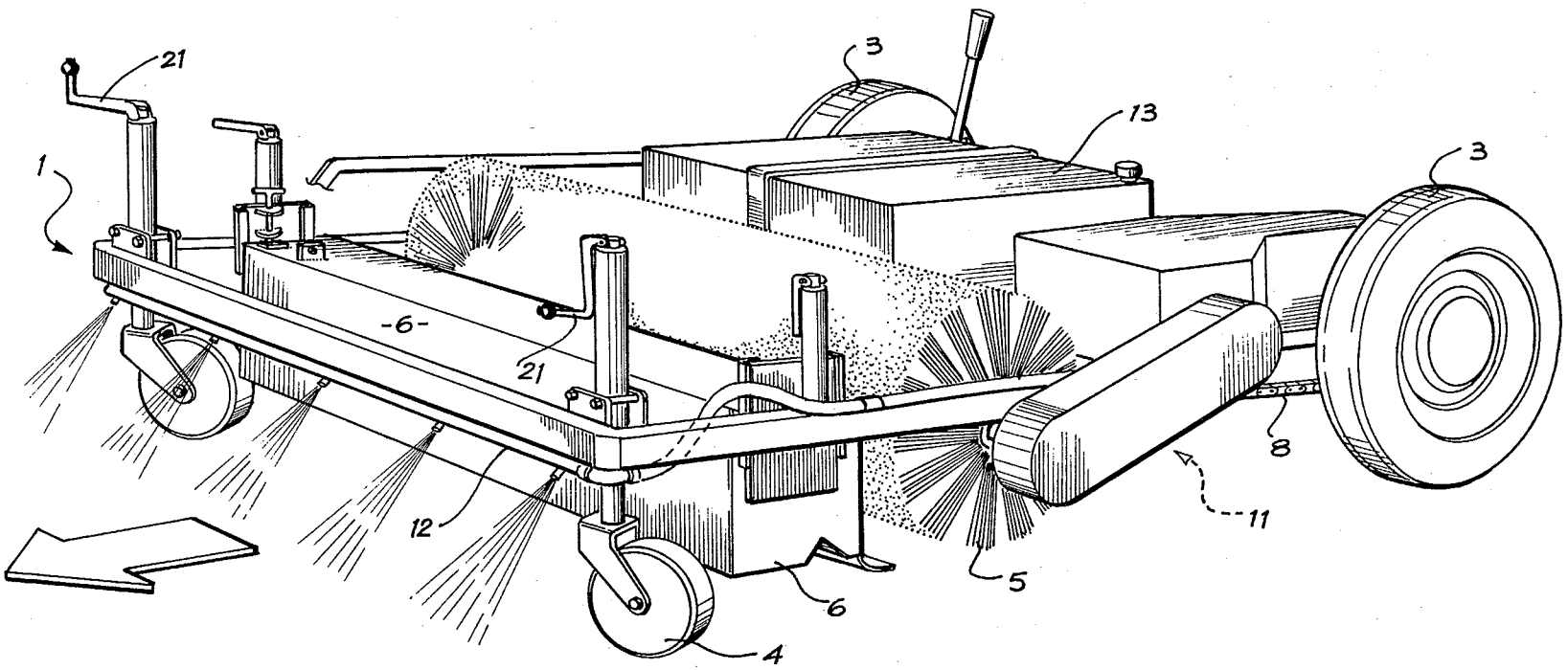
FIG. 1 is a perspective view of the sweeping apparatus of the present invention.

Referring generally to the drawings, an industrial sweeper in accordance with the present invention includes a main framework 1, ground engaging rear wheels 3 and ground engaging front wheels 4. The rear wheels 3 are affixed to a rotatable rear axle assembly 2 which is mounted in the vicinity of the rearward end of the framework 1.

A cylindrical sweeping brush 5 is rotatably mounted within the framework 1 and is driveable for rotation at drive sprocket 10. A chain drive 8 transmits drive from rear axle 2, through reduction gear set 7 to a common axle bearing a drive sprocket 9 and a drive pulley 17. A drive chain 11 links drive sprockets 9 and 10 so that sweeping brush 5 rotates in response to the simultaneous rotation of rear axle 2, subject to the translation of drive by gear set 7. The interposition of gear set 7 ensures that the simultaneous rotation of sweeping brush 5 and rear axle 2 are in opposite directions.

An elongate refuse catcher 6 is mounted transversely across the forward end of framework 1 and has an elongate opening through which passes refuse swept up by rotating sweeping brush 5. It has been found that optimum sweeping efficiency is obtained when refuse catcher 6 is mounted forwardly of sweeping brush 5 and the direction of rotation of the latter is opposite to that of rear axle 2, as determined by the interposition of gear set 7.

A sprinkler pipe 12 extends transversely across the front end of the sweeping apparatus and is perforated along its length with small sprinkler holes, as shown in the drawings. One end of sprinkler pipe 12 is connected to a water line 16 which connects, at its other end, to the outlet of a water pump 14. The inlet of water pump 14 is connected by another water line 15 to the outlet of a water tank 13. Water pump 14 is driveable at drive pulley 18 which, in turn, is driveably connected with gear set 7 by drive belt 19 and drive pulley 17. Thus, water pump 14 is driven in response to rotation of rear axle 2 translated by gear set 7 and water is subsequently pumped from water storage tank 13, through water line 15 into water line 16, into sprinkler pipe 12 and through the water spray perforations spaced along the length of the sprinkler pipe. Water which is sprayed through the perforations in the sprinkler pipe lightly wets the ground ahead of the sweeper during travel of the latter and grives weight to smaller dust particles which might otherwise be swept into the air.

Figure 2:
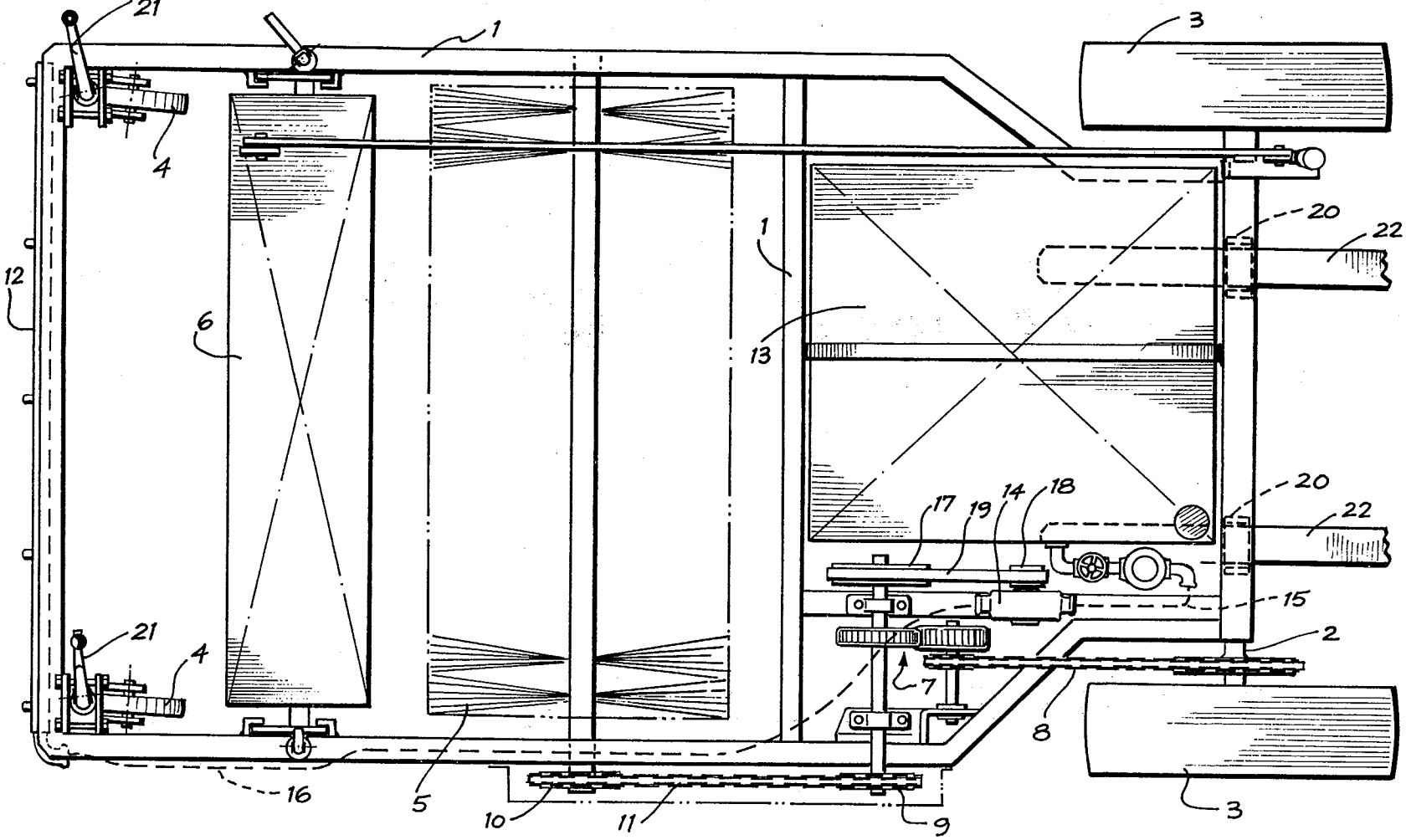
FIG. 2 is a plan view of one preferred form of the sweeping apparatus of the present invention.
Figure 3:
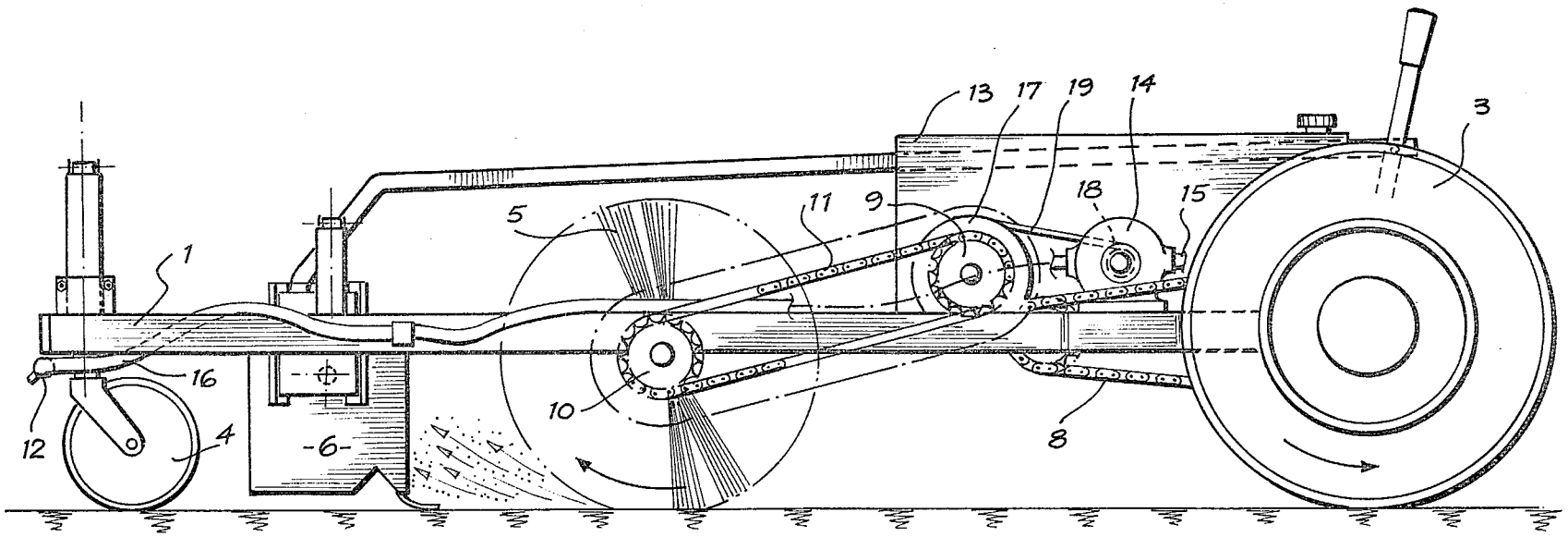
FIG. 3 is a side elevational view of the sweeping apparatus shown in FIG. 2.

As mentioned previously, the industrial sweeper of the present invention is adapted to be mobilised by an external prime mover, such as a fork lift. Since fork lifts are commonly used in industrial establishments, the use of a fork lift as a means of external motivation for the sweeping apparatus of the present invention is both convenient and economical. Accordingly, referring particularly to FIG. 2, sockets 20 are preferably affixed to the casing of rear axle 2 to enable fork lift prong 22 to be inserted in the sockets so that the sweeper may be mobilised. Alternatively, some other convenient form of mobilisation may be used depending upon the circumstances and enrivonment in which the sweeper is being utilised.

Front wheels 4 are independantly mounted on framework 1 and are provided with independantly operable height adjusting means. The height adjusting means preferably comprise a screw thread arrangement which enable the front of the sweeper to be raised and lowered at each side with respect to ground level by the turning of respective adjusting handles 21.

Although the accompanying drawings show the longitudinal axes of the sweeping brush, refuse catcher and sprinkler pipe to be at right angles to the direction of travel of the sweeper, the present invention also envisages a situation wherein the sweeping brush, refuse catcher and sprinkler pipe all have their longitudinal axes oblique to the direction of travel. Such an arrangement may be found to be useful when the refuse catcher is detached and, for various possible reasons, there is a requirement to simply sweep refuse to one side out of the path of travel of the sweeper. However, for normal sweeping operations along factory floors and driveways, the configuration shown in the drawings is preferable.

Gear set 7 is preferably designed to have a reduction ratio of 2:1 but may alternatively have any other ratio suited to a particular requirement. The drive means between the rear axle and the sweeping brush and between the rear axle and the water pump may also be varied within the limits of common knowledge without departing from the scope of the cited invention. However, the direction reversal provided by gear set 7 is desirable in so far as a direction of rotation of the sweeping brush opposite to that of the rear axle produces optimum efficiency from the sweeping apparatus. If, for some reason, the direction of rotation of the sweeping brush was the same as that of the rear axle, then it would be necessary to mount the refuse catcher rearwardly of the sweeping brush rather than in the forward position shown in the drawings.

As shown in FIG. 1, a cover is provided for the sweeping brush and water pump drive mechanisms so that the entire sweeping unit is presentable as a compact, covered assembly, the sweeping brush being the only visible part of the overall mechanism. The water tank, refuse catcher and drive mechanism cover may, if required, be painted for presentation purposes. Additionally, a water tap and filter may be fitted at the water tank outlet to provide a manual shut-off for the water supply and to prevent any sediment passing into the water pump and into the sprinkler pipe.

I claim:

1. Sweeping apparatus comprising:

a framework having forward and rearward ends;

an axle assembly bearing a pair of ground engaging rear wheels and mounted transversely in the vicinity of the rearward end of said framework;

a pair of independently suspended ground engaging front wheels mounted substantially toward the forward end of said framework;

a cylindrical sweeping brush comprising an elongate shaft with bristles extending radially therefrom and along the length thereof rotatably mounted transversely within said framework;

an elongate refuse catcher substantially equal in length to said sweeping brush and mounted near and substantially parallel thereto within said framework;

drive means connecting said axle assembly and said sweeping brush to cause the latter to rotate about its cylindrical axis in response to the rotation of said rear wheels;

an elongate, perforated sprinkler pipe extending across the forward end of said framework forwardly of and substantially parallel to said sweeping brush;

a water tank and a water pump both mounted within said framework;

water lines connecting an outlet of said water tank to an inlet of said water pump and an outlet of said water pump to said sprinkler pipe; and drive means connecting said axle assembly and said water pump to cause the latter to pump water from said water tank to said sprinkler pipe whereupon water is sprayed through the perforations in said sprinkler pipe in response to the rotation of said rear wheels.

2. Sweeping apparatus as claimed in claim 1 wherein said refuse catcher is mounted rearwardly of said sprinkler pipe, said sweeping brush is mounted rearwardly of said refuse catcher and said drive means connecting said axle assembly and said sweeping brush includes a gear set which establishes a direction of rotation of said sweeping brush opposite to that of said rear axle.

3. Sweeping apparatus as claimed in claim 2 wherein said gear set exhibits a reduction ratio.

4. Sweeping apparatus as claimed in claim 1 wherein the axes of said sprinkler pipe, said refuse catcher and said sweeping brush all lie at an angle of less than 90° to the longitudinal axis of the sweeper.

5. Sweeping apparatus as claimed in claim 1 wherein the axes of said sprinkler pipe, said refuse catcher and said sweeping brush all lie normal to the longitudinal axis of the sweeper.

6. Sweeping apparatus as claimed in claim 1 wherein said front wheels are independantly adjustable by means of a respective handle and screw thread arrangement to raise or lower the forward end of the sweeper with respect to ground level.

7. Sweeping apparatus as claimed in claim 1 wherein provision is made at the rearward end of the sweeper for the attachment of a prime mover.

8. Sweeping apparatus as claimed in claim 7 wherein the prime mover is a fork lift having a pair of prongs and the provision for attachment of the prime mover at the rearward end of the sweeper comprises a pair of sockets for accomodating the fork lift prongs.

9. Sweeping apparatus as claimed in claim 1 wherein said drive means connecting said axle assembly and said sweeping brush and said drive means connecting said axle assembly and said water pump include a chain drive arrangement.

* * * * *